United States Patent [19]

Gundlach et al.

[11] Patent Number: 5,028,779

[45] Date of Patent: Jul. 2, 1991

[54] CORONA CHARGING DEVICE

[75] Inventors: Robert W. Gundlach, Victor; Richard F. Bergen, Ontario, both of N.Y.

[73] Assignee: Xerox Corporation, Stamford, Conn.

[21] Appl. No.: 667,318

[22] Filed: Nov. 1, 1984

[51] Int. Cl.[5] ..... H01T 19/00; G03G 15/02

[52] U.S. Cl. ..... 250/325; 355/221

[58] Field of Search ..... 250/325, 324, 326; 355/3 CH

[56] References Cited

U.S. PATENT DOCUMENTS

| | | | |
|---|---|---|---|
| 2,576,047 | 11/1951 | Schaffert | 101/426 |
| 2,836,725 | 5/1958 | Vyverberg | 250/49.5 |
| 2,881,470 | 4/1959 | Berthold et al. | 18/1 |
| 2,956,847 | 10/1960 | Giaimo Jr. | 95/1.7 |
| 3,233,156 | 2/1966 | Jarvis et al. | 317/262 |
| 3,307,034 | 2/1967 | Bean | 250/49.5 |
| 3,435,309 | 3/1969 | Kolb et al. | 317/262 |
| 3,470,417 | 9/1969 | Gibbons | 317/4 |
| 3,566,223 | 2/1971 | Salger | 317/262 |
| 3,764,866 | 10/1973 | Bonaventura et al. | 317/262 A |
| 3,900,735 | 8/1975 | Jahn | 250/324 |
| 4,110,024 | 8/1978 | Gundlach | 355/3 TR |
| 4,306,271 | 12/1981 | Weber | 361/229 |

FOREIGN PATENT DOCUMENTS

| | | |
|---|---|---|
| 1195165 | 6/1965 | Fed. Rep. of Germany . |
| 2109868 | 9/1971 | Fed. Rep. of Germany . |
| 1063913 | 4/1967 | United Kingdom . |
| 1270273 | 4/1972 | United Kingdom . |
| 1317522 | 5/1973 | United Kingdom . |
| 2013133 | 8/1979 | United Kingdom . |

OTHER PUBLICATIONS

Research Disclosure, vol. 185, Sep. 1979, p. 504, No. 18543, Havant Hampshire, GB, J. Fiske et al.

Research Disclosure; "Corona Charger," -Feb. 1974-pp. 28-29.

*Primary Examiner*—Jack I. Berman

*Attorney, Agent, or Firm*—William A. Henry, II.

[57] ABSTRACT

A miniature coronode charging device comprising a plurality of coronode wires that are slanted with respect to the direction of travel of a charge receptor in order to reduce the effective distance between "hot spots" in the wires and thereby insure uniform charging of the receptor. The length of coronode wires between support points and their conducting contacts is very small, thereby eliminating sagging, singing, tensioning and capacitance problems when providing a corotron charging device of unlimited length. Individual high impedance to the plurality of coronode wires is provided in order to limit the amount of current passing to each of the wires from a high voltage source and thereby reduce the possibility of arcing and damages to the charge receptor. Spacing between coronoa wires and the charge receiving surface is small to provide low corona threshold and self-limiting charging.

8 Claims, 2 Drawing Sheets

CORONA CHARGING DEVICE

Reference is hereby made to copending applications U.S. Ser. No. 490,825, entitled "Self Limiting Mini-Corotron" filed on May 2, 1983 in the names of Robert William Gundlach and Richard Frank Bergen: U.S. Ser. No. 567,608, entitled "Segmented Coronode Scrotron" filed on Jan. 3, 1984 in the names of Robert William Gundlach; and U.S. Ser. No. 490,824, entitled "Mini-Coroton", filed on May 2, 1983 in the name of Richard Frank Bergen which are included herein by reference.

The invention relates to an inexpensive, compact and powerful corona generator capable of producing a uniform output for either charging or discharging purposes.

More specifically, this invention relates to an electrical corona generator capable of producing a highly efficient discharge and with greater stability and less sensitivity to wire sagging, singing and arching.

Many methods and devices have been disclosed in the prior art for producing a uniform electrostatic change upon a photosensitive member. One such charging device is disclosed in U.S. Pat. No. 2836,725, wherein an electrode in the form of a wire partially surrounded by an electrically grounded conductive shield is placed adjacent to a grounded receiving surface and a high voltage source connected to the wire wherein a corona discharge is produced. The corona discharge, in close proximity to the photosensitive member causes charged ions formed around the corona generator to flow to the grounded photosensitive member surface, and are deposited thereon to raise the surface potential to a relatively high level.

Historically, corona generators have been evaluated at wire to plane spacings of ¼" or greater. This is shown throughout the literature as in Charging Compendium of Zerography by O. A. Ulrich and L. E. Walkup, December 1963 (K-6631) of Battele Memorial Institute.

Most recent literature still discuss theory and experiments employing wire to plane spacings of ¼" to ½". Also, wire to plane spacings of ¼" are disclosed in a paper presented at the 1976 Electrophotography Conference by B. E. Springett entitled "Threshold Voltages and Ionic Mobilities in a Corona Discharge". The mini-corotron of the present invention employs a plane to wire to plane distance of from as small as 1.0 to 2.5 mm.

In the art of xerography, it has been found that consistent reproductive quality can only be maintained when a uniform and constant charge potential is applied to the photoconductive surface. In many automatic machines of this type, a single wire generator, generally referred to as a "corotron" is employed. Generally, the efficiency of the corotron is dependent on many factors including the gap distance between the wire and the photosensitive member surface, the nature of the generating wire material, the diameter of the wire and other physical features thereof and the amount of energy supplied to the corona emitter. Heretofore, these corona devices required large power supplies to meet high current and voltage requirements, were costly and took up a large area of machine space. Such units are designed for use with thin (90 μm) wire or wires located approximately 6 to 10 mm from a grounded photosensitive member or shield. Typically, for charging speeds near 4"/sec corona wire voltages for charging are near 7 kV with a bare plate receiver current of 66 μA for a 40 cm long wire (1.7 μA/cm). The cross sectional area of such a unit is near 6 $cm^2$. As Neblette's Handbook of Photography and Reprography states in the Seventh Edition published in 1977, page 348, "In practical corotron devices the wires are maintained at a potential above 600 V, usually charging the photoconductor surface to several hundred volts". These units were adequate in the past, but with present need for copiers that emit less ozone, use less energy, are less costly and take up less space, changes in corona generating devices are required. This was thought to be impossible because conventional thinking on corona generators and experience had taught that reducing the cavity partly surrounding the corotron and bringing the corotron closer to a receiver surface would cause arcing to occur and burn out the wire corotron and damage the photoreceptor. Also, it was thought that the use of long thin wires (0.0015") and small radius cavities would cause singing and sagging in the wires. Despite the conventional teachings to the contrary, heretofore copending U.S. application Ser. No. 490,824 discloses the discovery of a small mini-corona generating device that is energy efficient, useful in confined spaces and charges over a narrow region instead of a spread out area.

Additionally, we have discovered when working with charging units as disclosed in the above mentioned U.S. application that are placed close to a change receptor that corona begins from 1.5 mil (36 μm) diameter wire at less than 2.5 kV if the wire is supported 1.5 mm from a ground plane. Although still thinner wires are more difficult to handle in construction of the charging unit, and are more fragile in use, practical charging has been demonstrated with wires as small as 0.7 mil (18 μm) in diameter and 5 cm in length. Occasional arcing can burn out the wire or punch holes in the photoreceptor, however, unless the current from the wire is limited to about 10 μA/cm. Steady state current can be limited by a resistor between the power supply and the coronode, but is the wire is too long the IR voltage drop through the resistor becomes too large. A capacitance problem can arise as well if the wire is too large, too long, and too close to the ground plane. For example, the capacitance of a wire of radius a in a cylinder of radius b and length l, and where the permitivity of free space is Epsilon$_O$($\epsilon_0$) is given by:

$$C = (z\pi\epsilon_o)\left(\frac{l}{In\ b/a}\right)$$

Assume C of the wire to a plane at distance b away is about ¼ as much as a full cylinder at radius b. In that case, capacitance per meter is:

$$C=(2\pi\epsilon_0)(4In\ b/a)$$

For a 1.5 mil (90 μm) wire 1.5 mm from a photoreceptor, this becomes:

$$C=(\pi\epsilon_0)/(2In\ 83)=3.2\times10^{-12}F/m=3.2\times10^{-2}{}_pF/cm$$

At 3 kV, this stores 1.4 ergs per cm. Larger wires or, still worse, blades increase the capcaitively stored energy that could damage the photoreceptor on arching.

Long wires also have the problem of sagging and/or vibrating, or "singing", which, obviously, is more critical for a 1.5 mm spacing than for more common spacing of about 6 to 10 mm.

Accordingly, a solution to all three problems (I×R drop, the capacitive storage and discharge, and "singing" and sagging of the corotron wire) is provided int he present invention by supporting short lengths of small corona wires, in a way that their scanning paths overlap, and connecting each segment through a separate impedance to the power supply.

In another aspect of the present invention there is provided a corona charging device that enables close spacing of corotron wires to a photoconductor which in turn enables lower corotron voltages and higher efficiencies.

In yet another aspect of the invention, improved positional control of the wire and minimizing of arching are greatly enhanced.

In a further aspect of the present invention, an improved minature corotron device is disclosed that includes a series of individual wires with individual impedances connected thereto whereby impedance is controlled to the point that the corotron wires require no shield to provide threshold or maintain corona fields.

In a still further aspect of the present invention, individual impedances limit the energy deliverable to the corotron wires and thus prevent damage to the photoreceptor or other surface in the event of an arc.

The foregoing and other features of the instant invention will be more apparent from a further reading of the specification and claims and from drawings in which:

While the invention will be described hereinafter in connection with a preferred embodiment, it will be understood that it is not intended to limit the invention to that embodiment. On the contrary, it is intended to cover all alternatives, modification and equivalents as may be included within the spirit and scope of the invention as defined by the appended claims.

Figure 1:
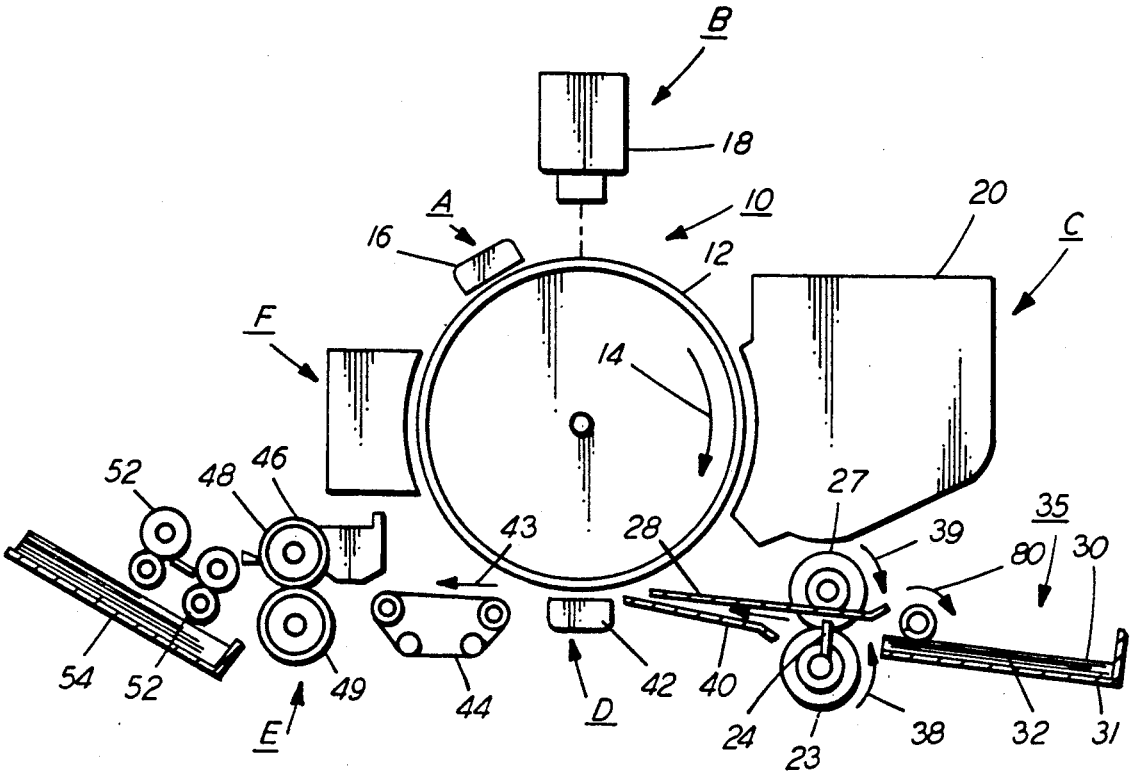
FIG. 1 is a schematic elevational view of an electrophotographic printing machine incorporating the features of the present invention.
Figure 4:
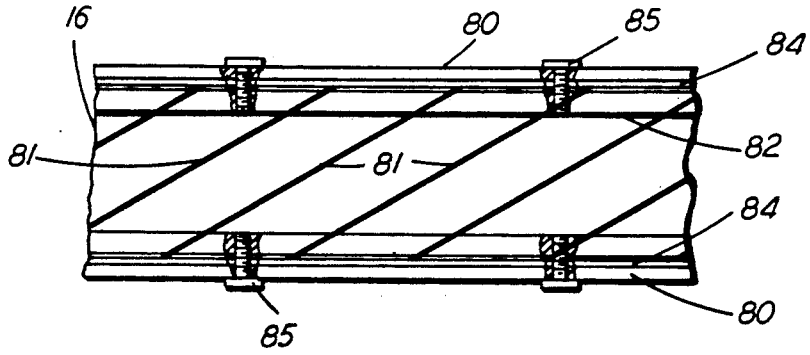
FIG. 4 is a partial bottom view of FIG. 3.

For a general understanding of an electrophotographic printing machine in which the features of the present invention may be incorporated, reference is made to FIG. 1 which depicts schematically the various components thereof. Hereinafter, like reference numerals will be employed throughout to designate identical elements. Although the apparatus of the present invention is disclosed as a means for charging a photosensitive member or for discharging a dielectric body, it should be understood that the invention could be used in an electrophotographic environment as a transfer device also.

Since the practice of electrophotographic printing is well known in the art, the various processing stations for producing a copy of an original document are represented in FIG. 1 schematically. Each process station will be briefly described hereinafter.

As in all electrophotographic printing machines of the type illustrated, a drum 10 having a photoconductive surface 12 coated securely onto the exterior circumferential surface of a conductive substrate is rotated in the direction of arrow 14 through the various processing stations. By way of example, photoconductive surface 12 may be made from selenium of the type described in U.S. Pat. No. 2,970,906. A suitable conductive substrate is made from aluminum.

Initially, drum 10 rotates a portion of photoconductive surface 12 through charging station A. Charging station A employs a corona generating device in accordance with the present invention, indicated generally by the reference numeral 16, to charge photoconductive surface 12 to a relatively high substantially uniform potential.

Thereafter drum 10 rotates the charged portion of photoconductive surface 12 to exposure station B. Exposure station B includes an exposure mechanism, indicated generally by the reference numeral 18, having a stationary, transparent platen, such as a glass plate or the like for supporting an original document thereon. Lamps illuminate the original document. Scanning of the original document is achieved by oscillating a mirror in a timed relationship with the movement of drum 10 or by translating the lamps and lens across the original document so as to create incremental light images which are projected through an apertured slit onto the charged portion of photoconductive surface 12. Irradiation of the charged portion of photoconductive surface 12 records an electrostatic latent image corresponding to the information areas contained within the original document.

Drum 10 rotates the electrostatic latent image recorded on photoconductive surface 12 to development station C. Development station C includes a developer unit, indicated generally by the reference numeral 20, having a housing with a supply of developer mix contained therein. The developer mix comprises carrier granules with toner particles adhering triboelectrically thereto. Preferably, the carrier granules are formed from a magnetic material with the toner particles being made from a heat fuseable plastic. Developer unit 20 is preferably a magnetic brush development system. A system of this type moves the developer mix through a directional flux field to form a brush thereof. The electrostatic latent image recorded on photoconductive surface 12 is developed by bringing the brush of developer mix into contact therewith. In this manner, the toner particles are attached electrostatically from the carrier granules to the latent image forming a toner powder image on photoconductive surface 12.

With continued reference to FIG. 1, a copy sheet is advanced by sheet feeding apparatus 35 to transfer station D. Sheet feed apparatus 35 advances successive copy sheets to forwarding registration rollers 23 and 27. Forwarding registration roller 23 is driven conventionally by a motor (not shown) in the direction of arrow 38 thereby also rotating idler roller 27 which is in contact therewith in the direction of arrow 39. In operation, feed device 35 operates to advance the uppermost substrate or sheet from stack 30 into registration rollers 23 and 27 and against registration fingers 24. Fingers 24 are actuated by conventional means in timed relation to an image on drum 12 such that the sheet resting against the fingers is forwarded toward the drum in synchronism with the image on the drum. A conventional registration finger control system is shown in U.S. Pat. No. 3,902,715 which is incorporated herein by reference to the extent necessary to practice this invention. After the sheet is released by finger 24, it is advanced through a chute formed by guides 28 and 40 to transfer station D.

Continuing now with the various processing stations, transfer station D includes a corona generating device 42 which is the same as corona device 16 and applies a spray of ions to the back side of the copy sheet. This attracts the toner powder image from photoconductive surface 12 to the copy sheet.

After transfer of the toner powder image to the copy sheet, the sheet is advanced by endless belt conveyor 44, in the direction of arrow 43, to fusing station E.

Fusing station E includes a fuser assembly indicated generally by the reference numeral 46. Fuser assembly 46 includes a fuser roll 48 and a backup roll 49 defining a nip therebetween through which the copy sheet passes. After the fusing process is completed, the copy sheet is advanced by conventional rollers 52 to catch tray 54.

Invariably, after the copy sheet is separated from photoconductive surface 12, some residual toner particles remain adhering thereto. Those toner particles are removed from photoconductive surface 12 at cleaning station F. Cleaning station F includes a corona generating device (not shown) adapted to neutralize the remaining electrostatic charge on photoconductive surface 12 and that of the residual toner particles. The neutralized toner particles are then cleaned from photoconductive surface 12 by a rotatably mounted fibrous brush (not shown) in contact therewith. Subsequent to cleaning, a discharge lamp (not shown) floods photoconductive surface 12 with light to dissipate any residual electrostatic charge remaining thereon prior to the charging thereof for the next successive imaging cycle.

Figure 2:
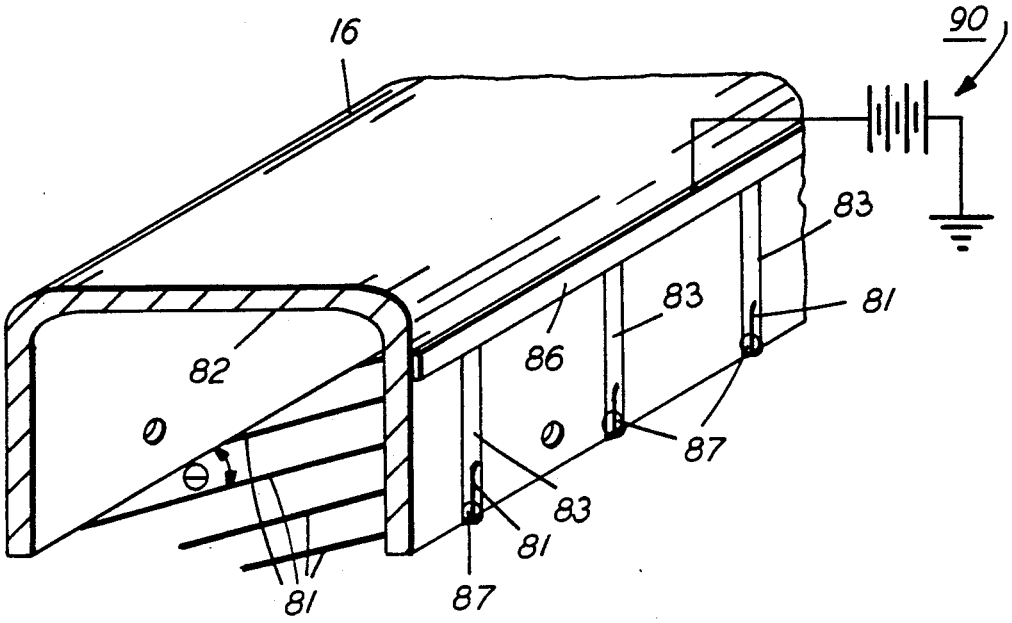
FIG. 2 is an enlarged partial plan view of the corona charging device that comprises the present invention showing slanted corotron wires.

It is believed that the foregoing description is sufficient for purposes of the present application to illustrate the general operation of an electrophotographic printing machine. Referring now to the subject matter of the present invention, FIG. 2 depicts the corona generating device 16 in greater detail. Corona generating units 16 and 42 are constructed similarly. Also the corona device of this invention could be placed over transport belt 44 and used as a discharge means if desired. In addition, A.C. voltage with a D.C. bias that would charge the photoreceptor to about the D.C. bias could be used if desired.

Referring now specifically to FIG. 2, the detailed structure and operation of an aspect of the present invention will be described. The corona generating unit, generally referred to as 16, is positioned above the photosensitive surface 12 and is arranged to deposit an electrical charge thereon as the surface 12 moves in a clockwise direction. The corona unit includes a block member that has an insulative shield member 82 which is rectangular in shape and has corona generator wires or coronodes 81 attached thereto. A slit or channel opening is formed in the bottom of the insulative shield member 82 opposite the moving photosensitive member and provides a path by which a low of ions discharged by the generator are directed towards and deposited upon photosensitive surface 12. For further details regarding the structure of a conventional corona unit, reference is had to the disclosure in U.S. Pat. No. 2,836,725.

The corona generating wires 81 are individually and separately connected through individual high voltage impedance means to a high potential source or power supply 90 through a buss bar or conductive line 86. This power supply, which could be positive or negative, supplies a much lower voltage than conventional corona generator power supplies and, as a result, aids in reducing arcing. In addition, individual wires 81 have impedances or resistances separately connected thereto as well as low capacitance to insure that arcing will not occur, which would damage the photoconductor. In this fashion, the capacitance of the wires to the photoreceptor is controlled to the point that the corona charging device requires no shield to provide threshold corona emissions or maintain corona fields. The voltage gradients are provided by the presence of the photoconductor; therefore, no shield is required and, as a result, there is no loss of the current to the shield. All current is used for charging, providing 100% charging effectiveness. The resistance is in series with each individual wire.

Figure 3:
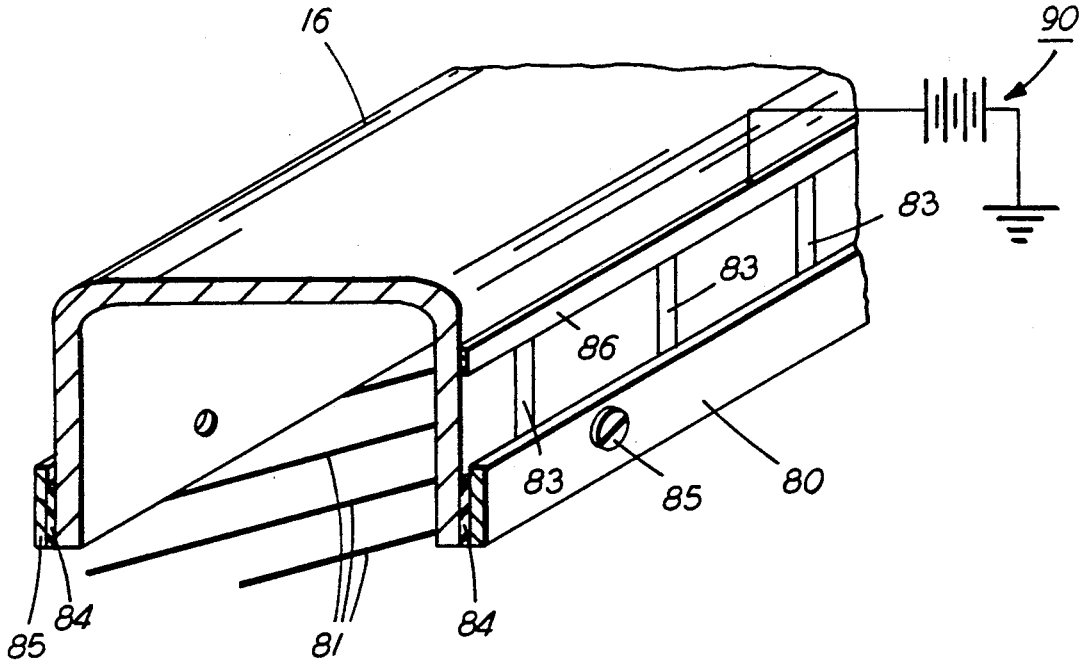
FIG. 3 is a partial perspective view of the apparatus of the present invention assembled.

In the commonly assigned copending application Ser. No. 490,824, the small wire to shield and wire to photoconductor dimensions disclosed therein require precise alignment of the corotron wire to a semi-circular cavity. The wire is as long as the photoconductor is wide which allows for some singing and sagging possibilities which are more detrimental for close spacing. As an improvement and more particularly as shown in FIGS. 2 and 3, the minature corotron 16 of the instant invention comprises very short wires 81 that reduce singing and sagging to a minimal level as well as make tension of the wires more easily accomplished. Also, corona for negative charging tends to be spotty, i.e., emission points are seen at intervals of about 1 cm. To correct this problem, the wires are angled at an angle from the direction of travel to reduce the effective distance between "hot spots" to d cos $\theta$, where d is the actual distance of separation and $\theta$ is the angle of the wires relative to the long axis of the unit.

To accomplish the stringing of individual corona wires 81 of FIGS. 2 and 3, a wire is helically wound around insulating member 82 which has a U-shaped channel, then cut after tightening to conductive pads 87 each of which is connected to conducting line 86 through resistive strips 83. Pads 87 should be as small as possible, consistent with ease of insuring connection to the corona wires 81 pressed into contact with the pads 87. Resistive strips 83 can be a screen printed binder film made partially conducting by loading with carbon black particles.

Alternatively, insulating member 82 might consist of glass, porcelain, alumina, or the like, in which case resistive strips 83 can consist of a glaze of ruthenium oxide in a glass binder, kiln fired onto insulating member 82. Each wire segment overlaps with the next just enough to give continuous coverage of the photoreceptor or photoconductor 12 scanning perpendicular to the long axis of the unit. It should be appreciated that other configurations are possible using these principles, such as staggered wire segments.

In practice of the present invention, an electrometer showed surprisingly uniform potential along sections of uniform charging speed with the use of a selenium plate or with an aluminum backed 1 mil Mylar at about one and ten inches per second with 3.3 kV on 1.5 mil wire. A positive strip charged to 1100 and 700 volts, respectively, for the two speeds. A negative section charged to 1200 and 800 volts, respectively. A coronode wire to receptor spacing of 1.5 mm was used.

As shown in FIG. 3, separate wires 81 span the U-shaped channel of member 82 which is insulative and are placed in contacting relationship with conducting pads 87 by the tightening of screws 85 against outside insulative members 80 that have thin rubber coatings 84 on their inside surfaces to insure that the wires remain stationary. High voltage means 90 supplies voltage to the conducting line 86 connecting each contact pad 87 through resistors 83 so as to make the impedance into the wires in series with each individual wire. Individual impedances allows for closer spacing of the corotron to the photoconductive surface than heretofore thought possible, since with a corotron as disclosed in U.S. application Ser. No. 490,824, now abandoned, the corotron would be placed only so close to the photoconductor and arcing would occur because the single long wire employed as the corotron has a built in capacitance, therefore, it could arc. However, with the present system the individual impedances and the short wires allow for closer spacing between the photoreceptor and corona wire without arcing.

Some of the advantages of the corona charging device of the present invention include the use of a low voltage to the coronodes or wires 81; the fact that as the photoconductor charges, the difference in voltage between the coronodes and the photoconductor is reducing; and this change in voltage can shut corona off in a controlled fashion; for example, threshold voltage near 2.2 kV are needed so that with a 3.2 kV to the wires, the photoconductor will charge to 1 kV and shut corona off.

In summary, a minature corotron device is disclosed in which the coronode wires are supported in short segments which are angled to the conventional wire direction. The segments are positioned so that their output currents overlap to deliver uniform current along the length of the device. Since the segments span a short distance, singing and sagging are reduced. The individual segments are connected to a high voltage source through a conducting line and a resistive material that serves to prevent arcing and resultant damage to the photoconductive surface.

While the invention has been described with reference to the structure herein disclosed, it is not confined to the details as set forth and is intended to cover any modifications and changes that may come within the scope of the following claims.

What is claimed is:

1. A compact, energy efficient corotron charging device for emitting a uniform discharge of corona to a grounded photoconductive surface member, comprising:

an insulating shield means positioned adjacent said photoconductive surface member, said shield means having a channel therein extending the length thereof; and a series of separate and individual corona emitting means positioned about 1.0 to 2.5 mm away from said photoconductive surface member and across said channel in order to reduce capacitance of each of said corona emitting means and against said shield means, each of said corona emitting means being slated with respect to the direction of travel of said photoconductive member such that the ions emitted from said corona emitting means overlap to thereby produce a more uniform charge.

2. The device of claim 1, including high impedance means individually connected between each corona emitting means and a high voltage power supply to prevent arcing.

3. The device of claim 2, wherein said high impedance means comprises a resistive film of ruthenium oxide.

4. The device of claim 3, wherein said resistive film is positioned to bridge between a conductive power line and conducting pad for contact with the coronode.

5. The device of claim 3, wherein said high voltage power supply communicates with said resistive film through a conductive means in order for energy to be applied to said resistive film.

6. The device of claim 5, wherein said high voltage power supply includes A.C. voltage.

7. The device of claim 5, wherein said high voltage power supply includes D.C. voltage.

8. The device of claim 1, wherein said corona emitting means include a series of individual wires.

* * * * *